US009259139B2

(12) United States Patent
Craven et al.

(10) Patent No.: US 9,259,139 B2
(45) Date of Patent: Feb. 16, 2016

(54) SANITARY FOOT SPRAYER FOR DRY POWDER PLANTS

(71) Applicant: HORMEL FOODS CORPORATION, Austin, MN (US)

(72) Inventors: Douglas J. Craven, Austin, MN (US); Nathan A. Kodesh, Austin, MN (US); Steven C. Wencl, Albert Lea, MN (US); Jacquie D. Deml, Ellendale, MN (US)

(73) Assignee: HORMEL FOODS CORPORATION, Austin, MN (US)

( * ) Notice: Subject to any disclaimer, the term of this patent is extended or adjusted under 35 U.S.C. 154(b) by 252 days.

(21) Appl. No.: 13/661,999

(22) Filed: Oct. 26, 2012

(65) Prior Publication Data

US 2014/0116468 A1 May 1, 2014

(51) Int. Cl.
*A47L 23/02* (2006.01)

(52) U.S. Cl.
CPC ..... *A47L 23/02* (2013.01)

(58) Field of Classification Search
CPC ..... A61L 2/16; A61L 2/18; A61L 2/22; A47L 23/02
See application file for complete search history.

(56) References Cited

U.S. PATENT DOCUMENTS 1,662,498 A * 3/1928 Gill ..... A47L 23/02 15/36
1,881,036 A * 10/1932 Uden ..... A47L 23/02 15/30
2,814,081 A 11/1957 Stevenson
3,066,338 A * 12/1962 Nappi ..... A47L 23/02 134/199
3,737,942 A * 6/1973 Casey ..... A47L 23/02 15/311
3,925,830 A * 12/1975 Delaney ..... A61H 35/006 4/615
3,973,286 A * 8/1976 Logan ..... A47K 3/022 15/104.92
4,233,707 A * 11/1980 Leblanc ..... A47L 23/263 15/311
4,425,677 A 1/1984 Cox
5,164,164 A * 11/1992 Strickler ..... A61L 2/18 15/104.92
5,792,712 A * 8/1998 Hori et al. ..... 442/123
5,820,821 A 10/1998 Kawagoe et al.
5,839,144 A * 11/1998 Willner ..... 15/36
5,964,959 A * 10/1999 Bleth ..... 134/32
5,996,160 A 12/1999 Pruitt
6,105,201 A * 8/2000 Min ..... 15/302
6,146,588 A 11/2000 Deighton
6,557,203 B2 * 5/2003 Meshbesher ..... A47L 23/22 15/104.92
6,584,636 B2 7/2003 Schlem
6,668,842 B1 12/2003 Wilke et al.
6,705,023 B1 3/2004 Hoover
6,886,210 B2 * 5/2005 Dean ..... 15/215
7,472,452 B2 * 1/2009 Junell ..... A47L 23/263 15/301
7,676,876 B1 3/2010 Ewert (Continued)

OTHER PUBLICATIONS

Chad'S Revolutionary Boot Scrubber/Wash, Chad Company, Inc. Date Unknown, 1 page.

*Primary Examiner* — Regina M Yoo
(74) *Attorney, Agent, or Firm* — IPLM Group, P.A.

(57) ABSTRACT

A sanitizer assembly for foot wear is provided that includes a base platform, a plurality of nozzles and an activation pump. The base platform includes a grate upon which footwear can be placed. The plurality of nozzles are positioned under the grate. The nozzles are configured and arranged to dispense a fine mist of alcohol-based sanitizer on the footwear. The activation pump is in fluid communication with the plurality of nozzles. The activation pump is further in fluid communication with a supply of alcohol-based sanitizer. In addition, the activation pump is configured and arranged to pump the alcohol-based sanitizer to the nozzles.

12 Claims, 5 Drawing Sheets

(56) References Cited

U.S. PATENT DOCUMENTS

| | | | | |
|---|---|---|---|---|
| 7,725,974 | B2 | 6/2010 | Hughes | |
| 8,161,590 | B2 | 4/2012 | Feeg et al. | |
| 2008/0104782 | A1 | 5/2008 | Hughes | |
| 2009/0098031 | A1 | 4/2009 | Crist | |
| 2010/0098582 | A1 | 4/2010 | Hansen et al. | |
| 2010/0296970 | A1 | 11/2010 | Trimarco et al. | |
| 2012/0167325 | A1 * | 7/2012 | Omidi | 15/210.1 |

* cited by examiner

SANITARY FOOT SPRAYER FOR DRY POWDER PLANTS

BACKGROUND

In food processing plants, keeping a sanitary environment is imperative to prevent the food from becoming contaminated. One method used to maintain a sanitary environment is by sanitizing footwear of workers as they enter the plant. A typical footwear sanitizing system is done with the use of brush scrubbers or a sprayed foam solution. However, in dry powder production facilities, it is desirable to minimize moisture on the plant production floor and on the footwear. The use of a boot scrubber system or foam solutions introduce unwanted moisture on the plant production floor and on the footwear and hence are undesirable in a dry powder production facility.

For the reasons stated above and for other reasons stated below which will become apparent to those skilled in the art upon reading and understanding the present specification, there is a need in the art for a sanitary foot sprayer system that does not introduce significant moisture in a dry powder plant.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a sanitizer assembly is provided. In one embodiment, the sanitizer system includes a base platform, a plurality of nozzles and an activation pump. The base platform includes a grate upon which footwear can be placed. The plurality of nozzles are positioned under the grate. The nozzles are configured and arranged to dispense a fine mist of alcohol-based sanitizer on the footwear. The activation pump is in fluid communication with the plurality of nozzles. The activation pump is further in fluid communication with a supply of alcohol-based sanitizer. In addition, the activation pump is configured and arranged to pump the alcohol-based sanitizer to the nozzles.

In another embodiment, a footwear sanitizer system is provided. The system includes a sanitizer assembly, a first mat and a second mat. The sanitizer assembly includes a base platform, a plurality of nozzles and an activation pump. The base platform includes a grate upon which the footwear can be placed. The plurality of nozzles are positioned under the grate. The activation pump is in fluid communication with the plurality of nozzles. The activation pump is further in fluid communication with a supply of alcohol-based sanitizer. The activation pump is configured and arranged to pump the alcohol-based sanitizer to the nozzles. The nozzles are further configured to dispense a fine mist of the alcohol-based sanitizer on the footwear. The first mat is positioned near the sanitizer assembly. The first mat contains dry crystal powder to be applied to the footwear after the sanitizer has been applied. The second mat is positioned near the first mat. The second mat is configured and arranged to remove any dry crystal powder from the footwear.

In yet another embodiment, a method of sanitizing footwear is provided. The method includes: dispensing a mist of alcohol-based sanitizer on footwear; placing the footwear in dry crystal powder; and removing dry crystal powder attached to the footwear.

BRIEF DESCRIPTION OF THE DRAWINGS

The present invention can be more easily understood and further advantages and uses thereof will be more readily apparent, when considered in view of the detailed description and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Figure 1:
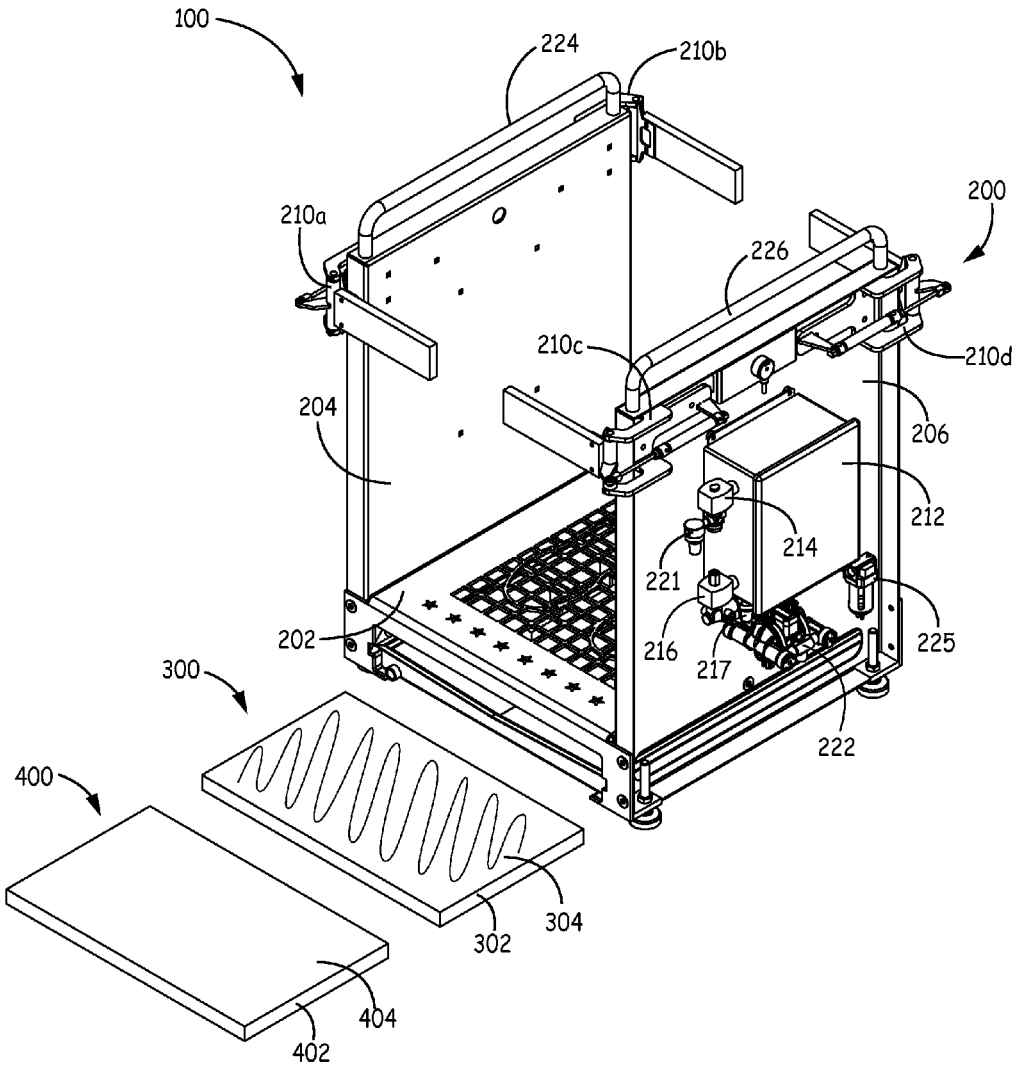
FIG. 1 is a side perspective view of a footwear sanitizer system of one embodiment of the present invention that includes a sprayer assembly.

Embodiments of the present invention provide a footwear sanitizer system that includes an automatic dispensing of an alcohol-based sanitizer on the bottom of footwear. The alcohol-based sanitizer dries quickly eliminating the moisture challenges experienced with other footwear cleaning methods. Referring to FIG. 1, a side perspective view of a footwear sanitizer system 100 of one embodiment is illustrated. The footwear sanitizer system 100 includes a sprayer assembly 200, a first mat 300 and a second mat 400. The sprayer assembly 100 selectively applies an alcohol-based sanitizer to a user's footwear. An example of alcohol-based sanitizer is Alpet D2 alcohol sanitizer, however, other types of alcohol-based sanitizers can be used. The first mat 300 includes a housing 302 (or mat base) which contains dry crystal powder 304 (such as, but not limited to, hydrogen peroxide crystals or quaternary ammonia-based crystals). As discussed further below, a user will step on the first mat 300 after the sprayer assembly 200 selectively applies the alcohol-based sanitizer to the user's footwear. The dry crystal powder will dry any remaining sanitizer on the user's footwear. The user will then step on the second mat 400. The second mat 400 includes a housing (or second mat base) 402 which and a surface 404 that is designed to remove any remaining dry crystals from the user's footwear.

Figure 3:
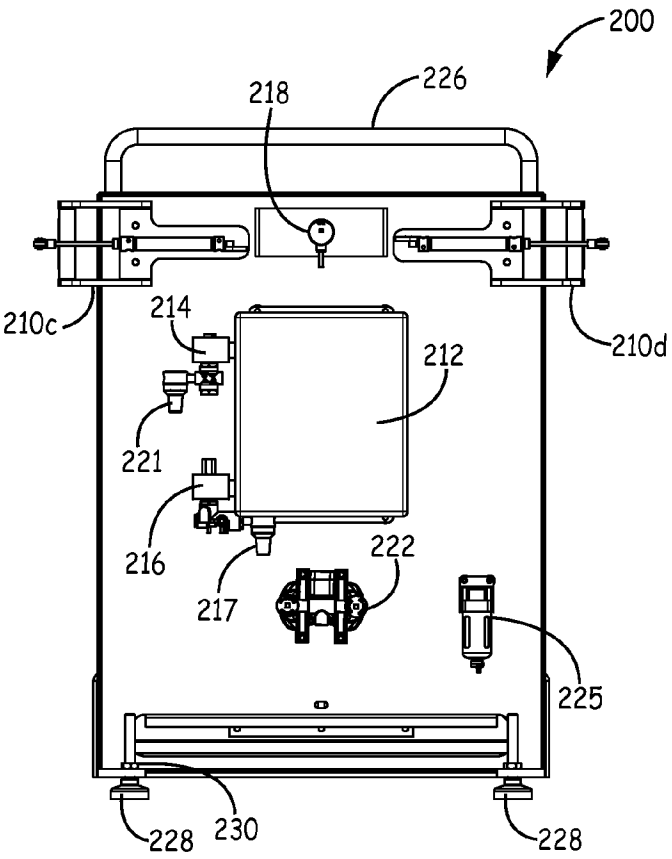
FIG. 3 is a side view of the sprayer assembly of the footwear sanitizer system of FIG. 1.
Figure 2:
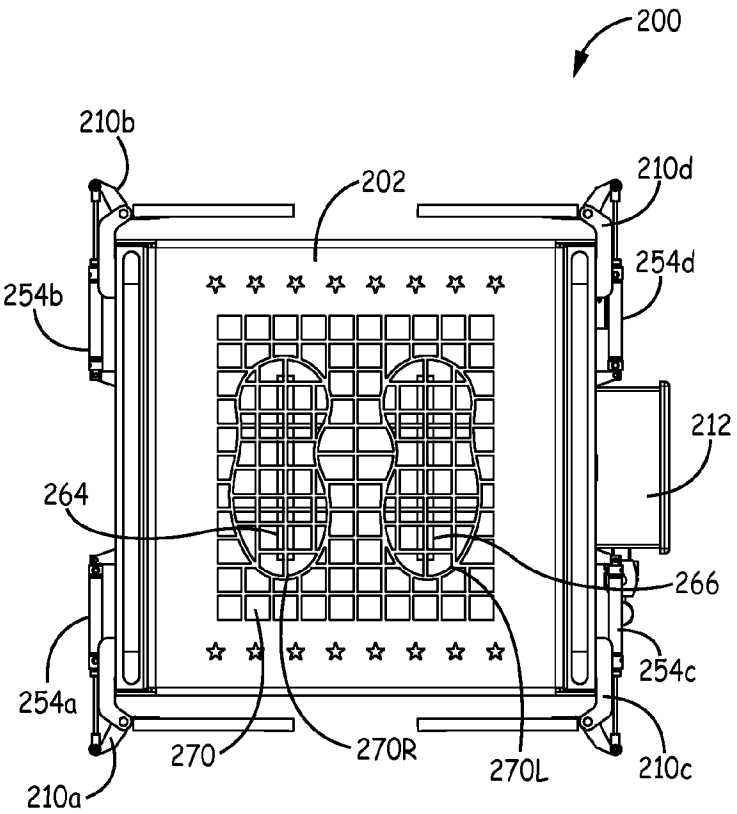
FIG. 2 is a top view of the sprayer assembly of the footwear sanitizer system of FIG. 1.
Figure 4:
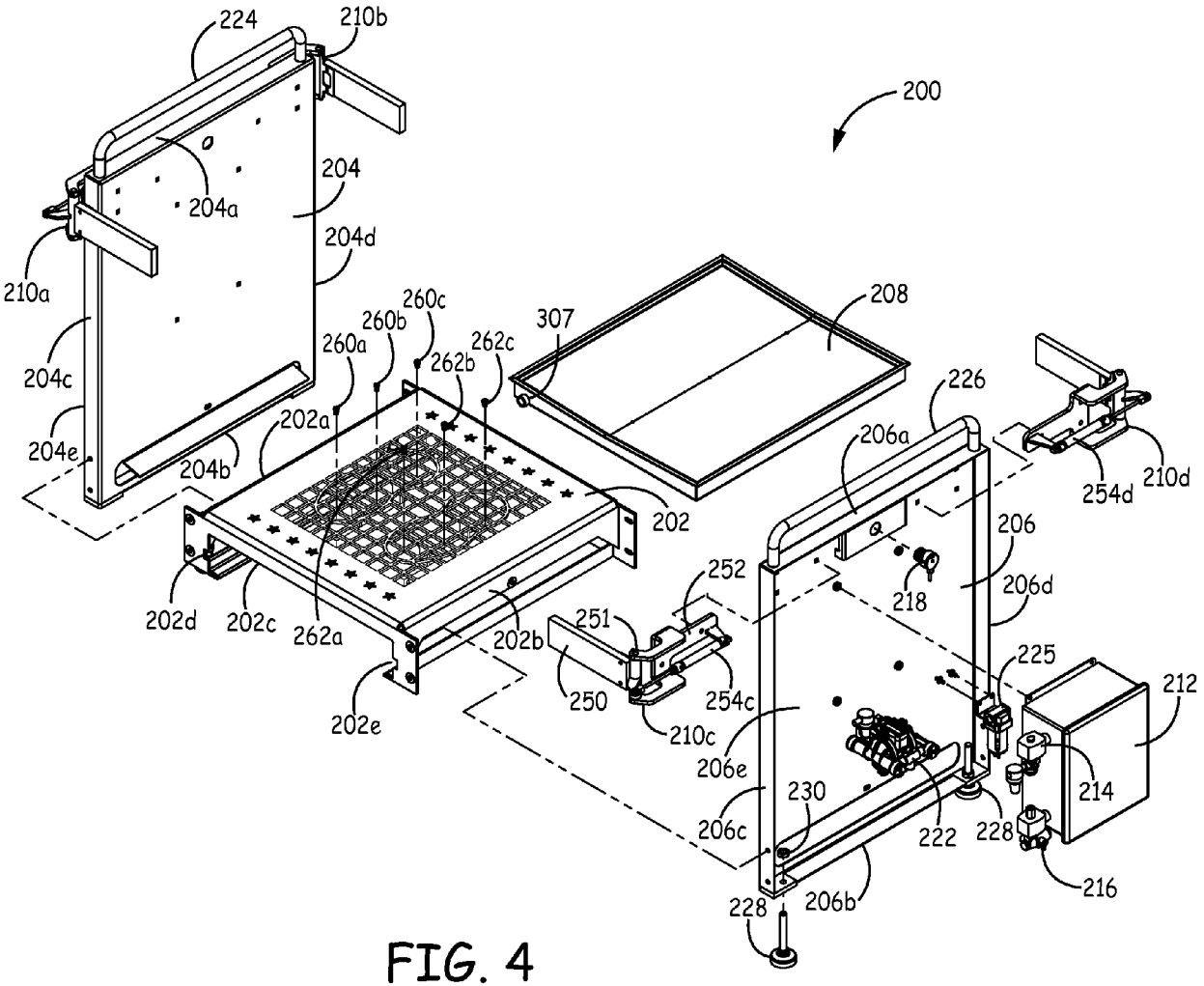
FIG. 4 is an unassembled side perspective view of the sprayer assembly of the footwear sanitizer system of FIG. 1.

The sprayer assembly 200 is now described in view of FIGS. 1 through 4. Referring to FIG. 4, a side view of the sprayer assembly 200 in an unassembled configuration is presented. As illustrated, the sprayer assembly 200 includes a base platform 202. The base platform 202 includes a first side 202*a* and an opposed second side 202*b*. A first side wall 204 is coupled to the first side 202*a* of the base platform 202. A second side wall 206 is coupled to the second side 202*b* of the base platform 202 in an opposed fashion to the first side wall 204. This configuration provides a pathway through the sprayer assembly 200 for the user. The base platform 202 includes a grate 270. The grate 270 allows for the sanitizer to be sprayed onto the user's footwear from under the base platform 202. The grate 270 is designed also to provide a no slip surface and in one embodiment is made from stainless steel. Referring to the top view in FIG. 2, the grate 270 in this embodiment has left and right footprints 270*r* and 270*l* designs. The designs indicate to the user where they are to place their footwear. Also illustrated in FIG. 2, under the respective left and right footprints 270*r* and 270*l* of the grate 270, are strategically placed dispensing manifolds 264 and 266. Nozzles 260*a*, 260*b*, 260*c*, 262*a*, 262*b* and 262*c*, illustrated in FIG. 4, are in fluid communication with the respective dispensing manifolds 264 and 266. The nozzles 260*a*, 260*b*, 260*c*, 262*a*, 262*b* and 262*c* direct a fine mist on the bottom of the user's footwear when the footwear are at the designated locations. The embodiment of FIG. 4, illustrates the use of three nozzles for each dispensing manifolds. That is, nozzles 260*a*, 260*b* and 260*c* are in fluid communication with dispensing manifolds 264 and nozzles 262*a*, 262*b*, and 262*c* are in fluid communication with dispensing manifolds 266. Other numbers of nozzles per dispensing manifold could be used and hence the present invention is not limited to three nozzles per dispensing manifold. An example of a nozzle that provides mist droplets in the preferred range is Model No. 11907 1/8PJ20 from the BETE Corporation of Greenfield Mass. An underside 202*c* of the base platform 202 includes opposed rails 202*d* and 202*e* as illustrated in FIG. 4. A drip pan 208 designed to collect excess sanitizer is designed to be slidably received in the opposed rails 202*d* and 202*e* in the underside 202*c* of the base platform 202. The drip pan 208 includes a drain 307 that can be used to remove excess sanitizer collected in the drip pan 208.

As illustrated in FIG. 4, the first side wall 204 includes a top edge 204*a* that is opposed to a bottom edge 204*b*. The base platform 202 is coupled proximate the bottom edge 204*b* of the first side wall 204. Also illustrated in FIG. 4 is a top edge 206*a* and an opposed bottom edge 206*b* of the second side wall 206. The base platform 202 is coupled proximate the bottom edge 206*b* of the second side wall 206. The first side wall 204 further includes a first side edge 204*c* and an opposed second side edge 204*d*. Similarly, the second side wall 206 also includes a first side edge 206*c* and an opposed second side edge 206*d*. Attached to each of the first and second side walls 204 and 206 are a pair of gate assemblies 210*a*, 210*b*, 210*c* and 210*d*. In particular, a first gate assembly 210*a* is coupled proximate the first side edge 204*c* and the top edge 204*a* of the first side wall 204 and the second gate assembly 210*b* is coupled proximate the second side edge 204*d* and the top edge 204*a* of the first side wall 204. A third gate assembly 210*c* is coupled proximate the first side edge 206*c* and the top edge 206*a* of the second side wall 206 and a fourth gate assembly 210*d* is coupled proximate the second side edge 206*d* and the top edge 206*a* of the second side wall 206. Each gate assembly 210*a*, 210*b*, 210*c* and 210*d* includes a gate bracket 252 that is coupled to an outer surface 204*e* and 206*e* of a respective side wall 204 and 206. A gate 250 is pivotally coupled to the gate bracket 252 via pivot connection 251. An actuator (generally designated as 254) is coupled between the gate bracket 252 and the gate 250 to selectively position the gate 252 to at least partially block the passageway formed by the base platform 202 and the side walls 204 and 206. Further description of the operation of the actuator 254 and the actuators 254*a*, 254*b*, 254*c* and 254*d* of the gate assemblies 210*a*, 210*b*, 210*c* and 210*d* is discussed below. Also illustrated in FIGS. 3 and 4 are adjustable feet 228 that are coupled to the respective bottom edges 204*b* and 206*b* of the respective first and second side walls 204 and 206. The feet members 228 are held in place via nuts 230. The first side wall 204 further includes a first handrail 224 that is coupled along the top edge 204 of the first side wall. Similarly, the second side wall 206 includes a second handrail 226 that is coupled along the top edge 206*a* of the second side wall 206. The handrails 224 and 226 provide a stable structure to grasp when stepping onto, standing on and stepping off of the base platform 202.

Figure 5:
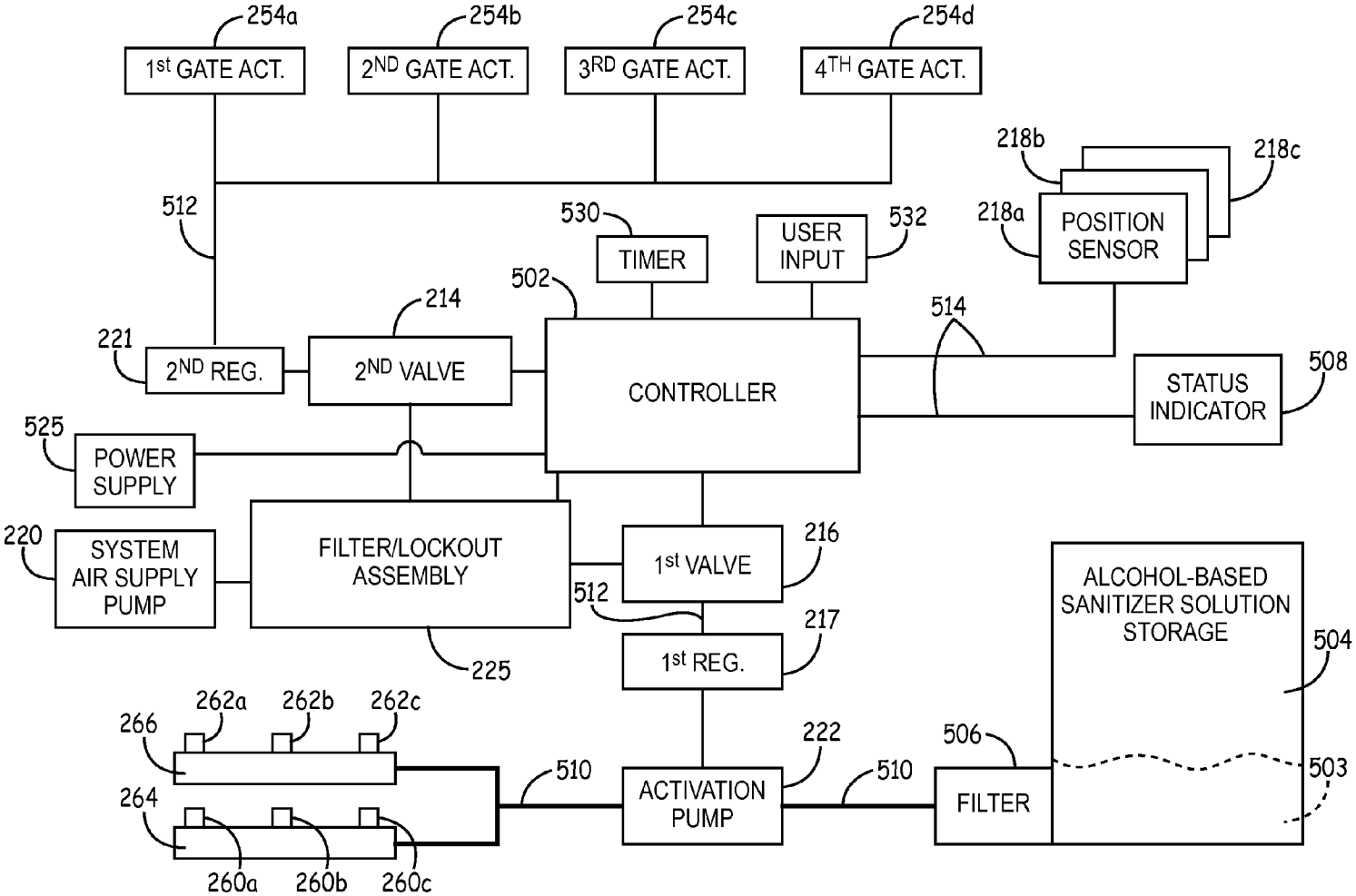
FIG. 5 is a block diagram of a sprayer assembly of one embodiment of the present invention.

The components that control the operation of the sprayer assembly 200 are coupled to the outer surface 206*e* of the second side wall 206. The control components contain a controller 502 (illustrated in FIG. 5) that is housed in a control housing 212 that is coupled to the second side wall 206 as illustrated in FIG. 4. Operation of the controller 502 is described in detail below. The control components further include a filter/lockout assembly 225 that is coupled to an external system air supply pump (system pump 220). The system pump 220 is shown in FIG. 5. In one embodiment, the filer portion of the filter/lockout assembly 225 is a pneumatic filter that filters out moisture from the air supplied by the system pump 220. The lockout portion of the filter/lockout assembly includes a value that shuts down the system for system maintenance. The system pump 220 provides air to the activation pump 222, which in one embodiment is a diaphragm pump. The control components further include first and second solenoid valves 216 and 214 and regulators 217 and 221 and at least one sensor 218 which in one embodiment is a photo eye sensor known in the art. How the control components work together to control operations of the sprayer assembly is described below in regards to FIG. 5 and FIG. 6.

FIG. 5 illustrates a block diagram of elements of the sprayer assemble 200. FIG. 5 further illustrates the connections between the components. Operation of the sprayer assembly 200 is controlled by the controller 502. The controller 502 can be a digital or an analog device capable of generating logic decisions to control operations of the sprayer assembly 200. The controller 502 is coupled to receive signals from at least one position sensor 218. In an embodiment illustrated in FIG. 5, more than one sensor is used. In this embodiment, three photo eye sensors 218*a*, 218*b* and 218*c* are used. The sensors 218*a*, 218*b* and 218*c* sense the position of the user and provide signals to the controller 502. Hence, the controller 502 uses the signals from the sensors 218*a*, 218*b* and 218*c* to, at least in part, determine a user position within the sprayer assembly 200 to start a sanitizing cycle. The embodiment of FIG. 5 also includes a user input 532 that is in communication with the controller 502. The user input 532 allows the user to communicate to controller 502. Example communications include an indication that a longer spray time is needed, or that operations should cease. The controller 502 is in communication with a timer 530. The controller 502 uses the timer 530, at least in part, to time the duration of the spray. This embodiment further includes a status indicator 508 that is in communication with the controller 502. In one embodiment, the status indicator 508 provides an indication of the status of operations of the sprayer assembly 200. For example, the status indicator 508 may be a light or an audible alarm that indicates to the user that the user can enter the sprayer assembly 200 or leave the spray assembly when the cleaning cycle is over.

As further illustrated in FIG. 5, a power supply 525 is coupled to supply power to the controller 502. The system pump 220 in this embodiment is external to the sprayer assembly 100. That is, in an embodiment, an air pump from the plant the sprayer assembly 200 is located, is used to supply an air flow to the filter/lockout assembly 225. The controller 502 selectively activates the first and second valves 216 and 214 to allow the air supplied by the system pump 220 to activate functions of the sprayer assembly 100. For example, valve 214 is selectively opened and closed to control the gate actuators 254*a*, 254*b*, 254*c* and 254*d* of the respective gate assemblies 210*a*, 210*b*, 210*c* and 210*d* and valve 216 is selective turned open and closed to activate the activation pump 222. As illustrated, the filter/lockout assembly 225 is coupled to supply air to the activation pump 222 via tubing 512. The coupling passes through the first valve 216 and a first regulator 217. The first valve 216 is a solenoid and as discussed above, is controlled by the controller 502. The regulator 217 is an air regulator in one embodiment. Hence, when the controller 502 wants to activate the activation pump 222 (the diaphragm pump) to deliver the spray to footwear of the user, the controller 502 opens the first valve 216. With the first valve 216 open, the air flow from the system pump 220 causes the activation pump 222 to pump out a solution from the solution storage container 504 through tubing 510. In one embodiment, solution filter 506 is used to filter the solution before it is delivered to the nozzles 262*a*, 262*b*, 262*c*, 264*a*, 264*b* and 264*c* so the nozzles do not become plugged with debris.

When the controller 502 wants to activate the actuators 254*a*, 254*b*, 254*c* and 254*d* of the gate assemblies 210*a*, 210*b*, 210*c* and 210*d*, the controller 502 opens up the second valve 214. This delivers a flow of air, from the system pump 220, through tubes 512 to activate the actuators 254*a*, 254*b*, 254*c* and 254*d* of the gate assemblies 210*a*, 210*b*, 210*c* and 210*d*. The bock diagram of FIG. 5, illustrates the gates actuators 254*a*, 254*b*, 254*c* and 254*d* being activated at the same time by a single valve-regulator line coupled to each of the actuators 254*a*, 254*b*, 254*c* and 254*d* of the gate assemblies 210*a*, 210*b*, 210*c* and 210*d*. This does not have to be the case. Separate valve-regulator lines could be coupled to operate the actuators of the gate assemblies separately. For example, gate assemblies 210*b* and 210*d* could be activated together to allow the user to step into the sprayer assembly 200 and gate assemblies 210*a* and 210*c* could be activated together to direct the user out of the sprayer assembly 200 to the first and second mats 300 and 400 after the footwear spraying is done. Hence, the present invention is not limited to a configuration that activates all of the gate assemblies 210*a*, 210*b*, 210*c* and 210*d* simultaneously. Moreover, in one embodiment, only one pair of gate assemblies 210*a* and 210*c* are used. In this embodiment, the gates 250 of gates assemblies 210*a* and 210*c* are opened after the sanitation cycle is complete. Moreover, in an embodiment, the side walls 204 and 206 are generally identically machined so that the control components and the gates can be mounted on either side wall 204 or 206 depending on the desired orientation and configuration desired by a customer.

Figure 6:
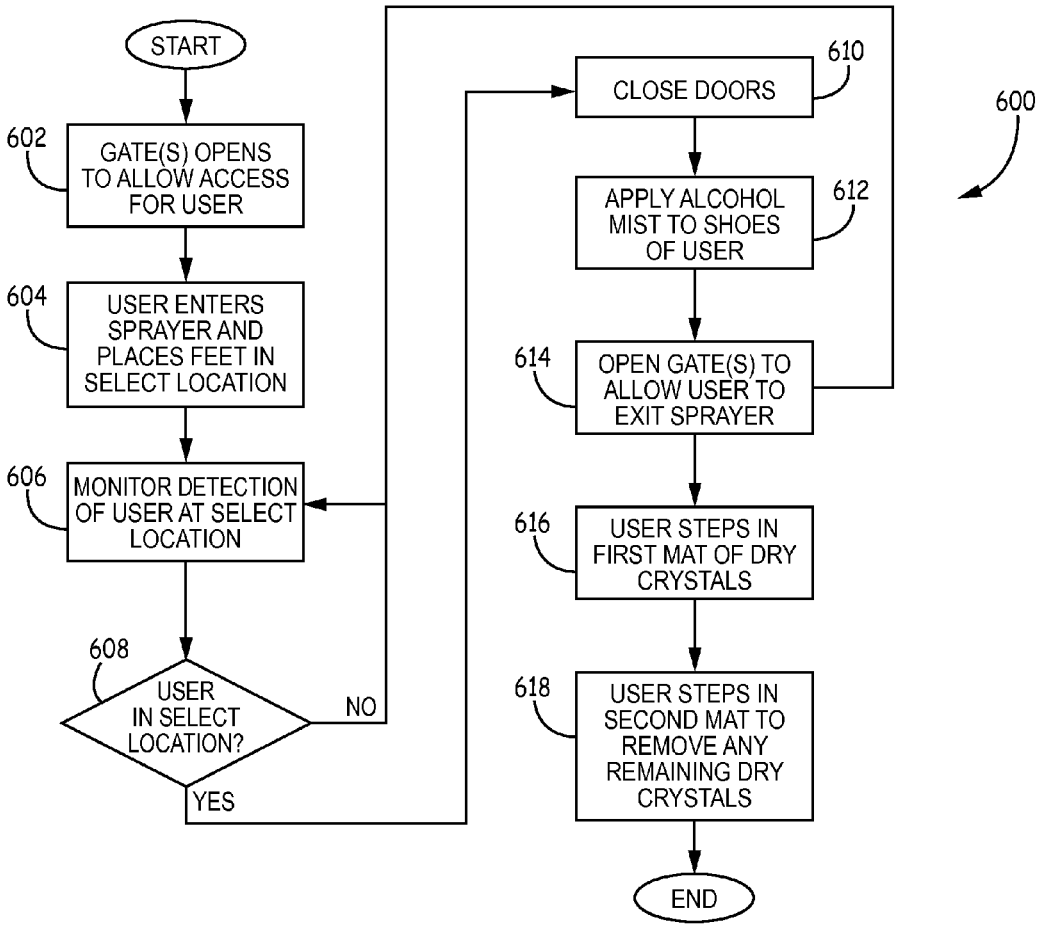
FIG. 6 is a footwear sanitizer flow diagram of one embodiment of the present invention.

FIG. 6 illustrates a footwear sanitizer flow diagram 600 of one embodiment of the present invention. In the embodiment shown, the process starts with the controller 502 having the gates 250 of the spraying assembly 200 in an open position (602). In an embodiment, with only two gates to control the exit of the spraying assembly, the process would start with the gates in the closed position. A user then enters the spray assembly 200 placing the user's footwear in the designated position on the grate 270 of the base platform 202 (604). The controller 502 monitors the output of the at least one sensor 218 to determine if a user is in the select location (606). If it is determined that a user has not been detected in the select location at step (608), monitoring continues at step (606). If it is determined that a user has been detected at the select location at step (608), the gates are closed (610). The controller 502 then dispenses the mist of sanitizer 503 on the user's footwear for a select amount of time (612). As discussed above, in one embodiment, the user can request additional dispensing time if they feel it is needed. Once the sanitizer 503 has been dispensed for the allotted time, the controller opens the gates 250 to allow the user to exit the spraying assembly 200. The user then steps into the first mat 300 that contains dry crystal powder 304 (616). The dry crystal powder 304 helps dry the sanitizer. The user then steps into the second mat 400 which contains a surface designed to remove any dry crystal powder 304 that attached to the footwear of the user (618). When the user steps off the second mat 400 the sanitizing cycle is complete.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A sanitizer assembly comprising:

a base platform with a grate upon which footwear can be placed, a plurality of nozzles positioned under the grate, the plurality of nozzles configured and arranged to dispense a fine mist of alcohol-based sanitizer on the footwear;

an activation pump in fluid communication with the plurality of nozzles, the activation pump further in fluid communication with a supply of alcohol-based sanitizer, the activation pump configured and arranged to pump the alcohol-based sanitizer to the plurality of nozzles; and a system pump configured and arranged to activate the activation pump.

2. The sanitizer assembly of claim 1, wherein the grate further includes feet patterns that convey to a user a footwear placement.

3. The sanitizer assembly of claim 1, further comprising:

a first side wall coupled to the base platform; and a second side wall coupled to the base platform, the first and second side walls forming a pathway to the base platform.

4. The sanitizer assembly of claim 3, further comprising:

at least one gate assembly coupled to one of the first and second side walls, the at least one gate assembly configured and arranged to selectively block entrance to the pathway.

5. The sanitizer assembly of claim 4, wherein each gate assembly further comprises:

a gate bracket configured and arranged to be coupled to a respective one of the first and second side walls;

a gate;

a pivot connection pivotally coupling the gate to the gate bracket; and an actuator configured and arranged to pivot the gate in relation to the gate bracket.

6. The sanitizer assembly of claim 5, further comprising:

a system pump in communication with the actuator to activate the actuator.

7. The sanitizer assembly of claim 6, wherein the system pump is a pneumatic pump and the actuator is an air cylinder.

8. A footwear sanitizer system comprising:

a sanitizer assembly including, a base platform with a grate upon which a footwear can be placed, a first side wall coupled to the base platform, a second side wall coupled to the base platform in an opposed fashion to the first side wall to form a pathway through the base platform, at least one gate assembly coupled to one of the first and second side walls, the at least one gate assembly configured and arranged to selectively block entrance to the pathway, a plurality of nozzles positioned under the grate, and an activation pump in fluid communication with the plurality of nozzles, the activation pump further in fluid communication with a supply of sanitizer, the activation pump configured and arranged to pump the sanitizer to the nozzles, the nozzles further configured to dispense a fine mist of the sanitizer on the footwear;

a first mat positioned near the sanitizer assembly, the first mat containing dry crystal powder to be applied to the footwear to dry the sanitizer on the footwear after the sanitizer has been applied by the nozzles; and a second mat positioned near the first mat, the second mat configured and arranged to remove any dry crystal powder from the footwear.

9. The footwear sanitizer system of claim 8, further comprising:

feet patterns in the grate that convey to a user footwear placement.

10. The footwear sanitizer system of claim 8, further comprising:

an actuator for each gate assembly; and a system pump configured and arranged to activate each actuator and the activation pump.

11. The footwear sanitizer system of claim 10, wherein the system pump is a pneumatic pump and each actuator is an air cylinder.

12. The footwear sanitizer system of claim 10, further comprising:

a controller coupled to control the system pump.

* * * * *